US010273630B2

(12) United States Patent
Bartelmuss

(10) Patent No.: US 10,273,630 B2
(45) Date of Patent: Apr. 30, 2019

(54) APPARATUS FOR ADJUSTING A SCRAPER BAR IN A LINE FOR PRODUCING A PAPER WEB

(71) Applicant: Klaus Bartelmuss, Teufenbach (AT)

(72) Inventor: Klaus Bartelmuss, Teufenbach (AT)

( * ) Notice: Subject to any disclaimer, the term of this patent is extended or adjusted under 35 U.S.C. 154(b) by 10 days.

(21) Appl. No.: 15/684,523

(22) Filed: Aug. 23, 2017

(65) Prior Publication Data

US 2018/0058004 A1 Mar. 1, 2018

(30) Foreign Application Priority Data

Sep. 1, 2016 (AT) ..... A 404/2016

(51) Int. Cl.
*D21F 1/24* (2006.01)
*D21F 1/48* (2006.01)

(52) U.S. Cl.
CPC ..... *D21F 1/24* (2013.01); *D21F 1/486* (2013.01)

(58) Field of Classification Search
USPC ..... 162/352
See application file for complete search history.

(56) References Cited

U.S. PATENT DOCUMENTS 3,953,284 A 4/1976 Evälahti
5,486,270 A * 1/1996 Schiel ..... D21F 1/486 162/352
5,660,689 A * 8/1997 Bartelmuss ..... D21F 1/486 162/352
6,372,093 B1 * 4/2002 Brewer ..... D21F 1/483 162/352
9,045,859 B2 6/2015 Gauss et al.
2003/0136539 A1 * 7/2003 Bartelmuss ..... D21F 1/486 162/352
2003/0183357 A1 * 10/2003 Sherril ..... D21F 1/00 162/352
2005/0205227 A1 * 9/2005 Bartelmuss ..... D21F 1/483 162/352
2012/0267065 A1 * 10/2012 Faufau ..... D21F 1/486 162/209
2014/0034261 A1 * 2/2014 Faufau ..... D21F 1/486 162/351

(Continued)

FOREIGN PATENT DOCUMENTS

DE 7423054 U 5/1976
DE 2510492 A1 9/1976

(Continued)

*Primary Examiner* — Mark Halpern
(74) *Attorney, Agent, or Firm* — Laurence A. Greenberg; Werner H. Stemer; Ralph E. Locher

(57) ABSTRACT

An apparatus for adjusting a scraper bar in a line for producing a paper web, having a wire, assigned to which are scraper bars oriented transversely to its direction of movement and situated at a distance from one another. The scraper bar is supported by a support bar and is adjustable with respect to the support bar and with respect to the wire by means of a positioning device. The scraper bar and the support bar are coupled together by way of links that are mounted thereon. The distance or the angular position of the scraper bar with respect to the support bar and thus with respect to the wire is adjustable by a displacement of the scraper bar with respect to the support bar.

20 Claims, 9 Drawing Sheets

(56) References Cited

U.S. PATENT DOCUMENTS

| | | | | |
|---|---|---|---|---|
| 2014/0202648 | A1* | 7/2014 | Faufau | D21F 1/486<br>162/209 |
| 2014/0216676 | A1* | 8/2014 | Gauss | D21F 1/486<br>162/348 |
| 2015/0122443 | A1* | 5/2015 | Faufau | D21F 1/486<br>162/300 |
| 2016/0201262 | A1* | 7/2016 | Faufau | D21F 1/486<br>162/209 |

FOREIGN PATENT DOCUMENTS

| | | | |
|---|---|---|---|
| DE | 29823850 | U1 | 1/2000 |
| EP | 1215336 | A2 | 6/2002 |
| EP | 2762635 | A1 | 8/2014 |
| WO | 9838380 | A1 | 9/1998 |

* cited by examiner

APPARATUS FOR ADJUSTING A SCRAPER BAR IN A LINE FOR PRODUCING A PAPER WEB

CROSS-REFERENCE TO RELATED APPLICATION

This application claims the priority, under 35 U.S.C. § 119, of Austrian patent application A 404/2016, filed Sep. 1, 2016; the prior application is herewith incorporated by reference in its entirety.

BACKGROUND OF THE INVENTION

Field of the Invention

The present invention relates to an apparatus for adjusting a scraper bar in a line for producing a paper web, having a wire, assigned to which are scraper bars oriented transversely to its direction of movement and situated at a distance from one another. The scraper bar is supported by a support bar and is capable of adjustment with respect to the support bar and thus with respect to the wire by means of a positioning device.

Prior art lines for producing a paper web have a self-contained wire which is caused to rotate, onto which a mixture of substances for producing the paper web is deposited at the start of the line. In order to remove the liquid contained therein from the mixture of substances, there are present beneath the wire scraper bars, which extend transversely to the wire, and which are spaced apart from one another in the direction of movement of the wire. Arranged additionally beneath the wire are suction boxes, through which the liquid that has exited from the mixture of substances is extracted. Furthermore, felt belts as well as drying cylinders, by means of which the paper web is dried, are provided in the line after the wire.

The liquid that has passed through the wire is scraped off by the scraper bars when they make contact with the underside of the wire. Furthermore, when the surface of the scraper bars encloses an acute angle with the wire, which angle opens in the direction of movement of the wire, a suction force is exerted by the scraper bars on the wire or on the liquid that has exited from the mixture of substances. Since the scraping effect and the suction force, which are exerted by a scraper bar, are dependent on the elevation and on the angular position of the scraper bar with respect to the wire, there is a requirement to provide a positioning device, by means of which the scraper bar is adjustable with respect to the support bar for the scraper bar in its elevation and/or in its angular position, with the result that the scraper bar is adjustable in its elevation and/or in its angular position with respect to the wire.

U.S. Pat. No. 9,045,859 B2 and its counterpart European published patent application EP 2762635 A1 describes the provision of guide blocks between a support bar for the scraper bar and the scraper bar. The blocks are capable of displacement by means of a positioning spindle in the longitudinal direction of the support bar and/or the scraper bar. The guide blocks and the scraper bar in this case are provided with sliding block guides, by means of which, in the event of a displacement of the guide blocks, the scraper bar is capable of adjustment in its elevation and/or in its angular position with respect to the support bar and thus with respect to the wire.

The difficulty associated with that prior art apparatus, however, is that components of the mixture of substances are contained in the liquid exiting from the mixture of substances, which components find their way into the sliding block guide, causing it to move sluggishly, on account of which very high actuating forces must be applied via the positioning spindle for the displacement of the guide blocks with respect to the scraper bar. For this reason, the positioning spindle must be heavily dimensioned or more frequent cleaning of the sliding block guide must be undertaken.

SUMMARY OF THE INVENTION

It is accordingly an object of the invention to provide a device for adjusting a scraper bar which overcomes the above-mentioned and other disadvantages of the heretofore-known devices and methods of this general type.

With the above and other objects in view there is provided, in accordance with the invention, a apparatus for adjusting a scraper bar in a line for producing a paper web with a wire and scraper bars oriented transversely to a direction of movement of the wire and situated at a spacing distance from one another. The novel apparatus comprises:

a support bar supporting the scraper bar adjustably with respect to the support bar and with respect to the wire;

a positioning device for adjusting the scraper bar with respect to the support bar and with respect to the wire;

links mounted to the scraper bar and to the support bar for coupling the scraper bar and the support bar to one another; and wherein a distance or an angular position of the scraper bar with respect to the support bar and with respect to the wire is adjusted by a displacement of the scraper bar with respect to the support bar.

In other words, the objects of the invention are achieved in that the scraper bar and the support bar are coupled together by means of links mounted thereon, and the distance or the angular position of the scraper bar with respect to the support bar and thus with respect to the wire is capable of adjustment by a displacement of the scraper bar with respect to the support bar.

The positioning device is preferably constituted by a pivotable angled lever mounted on the support bar and a positioning rod linked on the one hand to the angled lever and on the other hand to the scraper bar, wherein the scraper bar is capable of displacement parallel to the support bar by pivoting of the angled lever. The positioning rod in this case can be capable of adjustment in its effective length. Furthermore, a positioning cylinder can be arranged on the angled lever and can be pivotable therewith, which positioning cylinder is rotatably mounted with respect to the angled lever.

The rotatable positioning cylinder is preferably configured on its side facing towards the angled lever with a spirally running groove, and a positioning plate in the form of a curved arch and configured with teeth is attached to the support bar, which positioning plate interacts with the spirally running groove in such a way that the angled lever is capable of being caused to pivot by rotation of the positioning cylinder. The angled lever in this case is capable of being caused to pivot between two abutments. Furthermore, the positioning cylinder is capable of being caused to rotate by means of a crank.

Furthermore, support plates are preferably attached to the scraper bar and to the support bar, on which support plates linking elements are mounted, of which the pivot bolts are oriented transversely to the longitudinal direction of the scraper bar and/or the direction of sliding. The linking elements can be of H-shaped configuration, having two longitudinal braces situated at a distance from one another and having a transverse brace connecting these together, wherein the free ends of the longitudinal braces are penetrated by the pivot bolts.

According to a further preferred embodiment, a support plate is attached to the support bar, on which support plate the one ends of two linking elements are mounted, wherein the pivot axes of these linking elements together enclose an acute angle of 1° to 10°, preferably of about 5°, and wherein the other ends of the linking elements are mounted on support elements, which are mounted on a support plate attached to the scraper bar, and the pivot axes of the linking elements mounted on the support elements as well as the pivot axes of the support elements, which are mounted on the support plate attached to the scraper bar, intersect one another spatially. The angular position of the scraper bar with respect to the support bar is capable of adjustment in this case by as much as 5°, preferably by 3°, by a displacement of the scraper bar with respect to the support bar. Furthermore, the two linking elements in their initial position exhibit different angular positions of, for example, 19.1° and 33.5° in relation to a vertical plane, which, in the event of a displacement of the scraper bar with respect to the support bar, increase to angular positions of, for example, 33.7° and 51.5° in relation to the vertical plane.

Other features which are considered as characteristic for the invention are set forth in the appended claims.

Although the invention is illustrated and described herein as embodied in a apparatus for adjusting a scraper bar in a papermaking facility, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
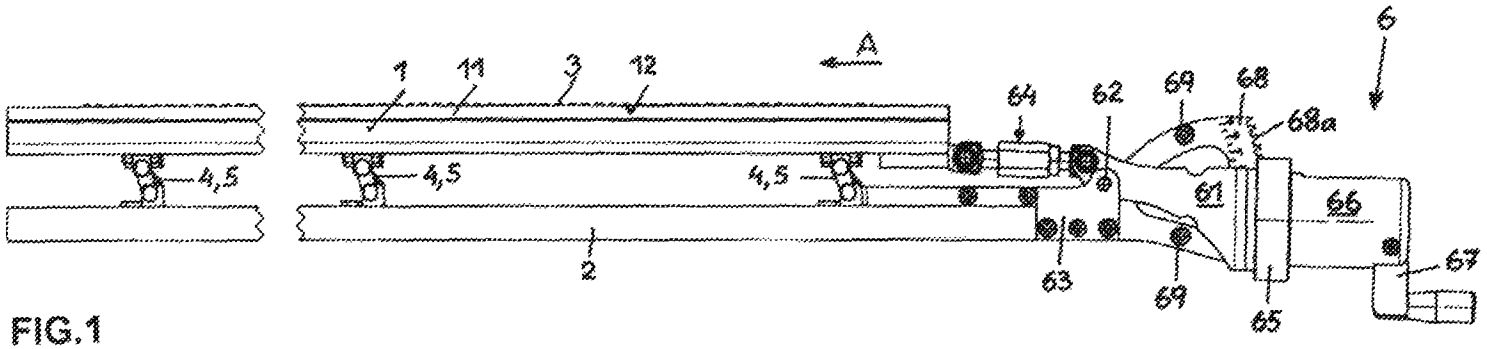
FIG. 1 depicts a support bar, a scraper bar coupled thereto and a positioning device for the displacement of the scraper bar with respect to the support bar in a line for producing a paper web, in a first position of the scraper bar with respect to the support bar, in a side view.

Referring now to the figures of the drawing in detail and first, particularly, to FIG. 1 thereof, there is shown a scraper bar 1, a support bar 2 assigned thereto and a wire 3, also referred to as a screen, situated above the scraper bar 1 in a facility for producing a paper web. The wire 3 is caused to travel over a wearing layer 11 situated on the scraper bar 1. The scraper bar 1 is configured with a scraper edge 12, by means of which liquid, which exits from a pulp (i.e., a mixture of substances for producing the paper web) that is present on the wire 3 and finds its way to the underside of the wire 3, is scraped away from the wire 3.

The scraper bar 1 is coupled to the support bar 2 by links 4 and 5, which are pivotally mounted on the scraper bar 1 and on the support bar 2. A positioning device 6 is provided, furthermore, by means of which the scraper bar 1 is capable of displacement parallel to the support bar 2. The distance of the scraper bar 1 with respect to the support bar 2 is caused to vary by a displacement of the scraper bar 1 with respect to the support bar 2 by means of the links 4 of a first embodiment. The angular position of the scraper bar 1 with respect to the support bar 2 and/or with respect to the wire 3 is varied by a displacement of the scraper bar 1 with respect to the support bar 2 by means of the links 5 of a second embodiment.

The scraping effect of the scraper bars can be controlled by a displacement of the scraper bars in relation to their elevation, and the elevation of the wire, and thus its path, can be influenced. Furthermore, the scraper bars can be displaced into a non-effective position as a result.

The angle formed between the wire and the surface of the scraper bars in the direction of movement of the wire after the front scraper edge of the scraper bar can be adjusted in relation to its size, and thus in relation to its suction effect, by a displacement of the scraper bars in their angular position.

The positioning device 6 is configured with an angled lever 61, which is mounted by means of a pivot bolt 62 between two support plates 63 situated at a distance from one another. The support plates 63 are attached to the support bar 2. A positioning rod 64 that is adjustable in its length is provided, furthermore, which is articulated with its one end on the associated end of the angled lever 61, and with its other end on the scraper bar 1. The scraper bar 1 is displaced in the direction of the arrow A by pivoting of the angled lever 61 in the anticlockwise direction, as a result of which, by using links 4 of the first embodiment, the distance of the scraper bar 1 to the support bar 2 is reduced and/or the scraper bar 1 is displaced downwards from the wire 3. By using links 5 of the second embodiment, the scraper bar 1 is displaced in its angled position with respect to the support bar 2 and/or with respect to the wire 3.

Attached to the angled lever 61 is a retaining ring 65, by means of which a positioning cylinder 66 is connected to the angled lever 61 in such a way that it is capable of being caused to pivot together with the latter, while nevertheless being capable of rotation with respect to the angled lever 61. The positioning cylinder 66 is caused to rotate by means of a crank 67. A positioning plate 68 is attached to the support plates 63, furthermore, which is configured in the form of a curved arch on its edge assigned to the positioning cylinder 66 and is configured with teeth 68*a* along its edge. The positioning plate 68 interacts with the positioning cylinder 66 in such a way that the angled lever 61 is caused to pivot by a rotation of the positioning cylinder 66. The pivoting movement is restricted by two abutments 69. The scraper bar 1 is displaced with respect to the support bar 2 by pivoting of the angled lever 61.

Represented in FIG. 1 is the position of the links 4, 5, in which the scraper bar 1 has not been displaced and it bears against the underside of the wire 3 over its entire surface. Represented in FIG. 1A is the position of the links 4, 5, in which the scraper bar 1 has been displaced, wherein it has been adjusted either in its distance or in its angular position with respect to the support bar 2.

Figure 1A:
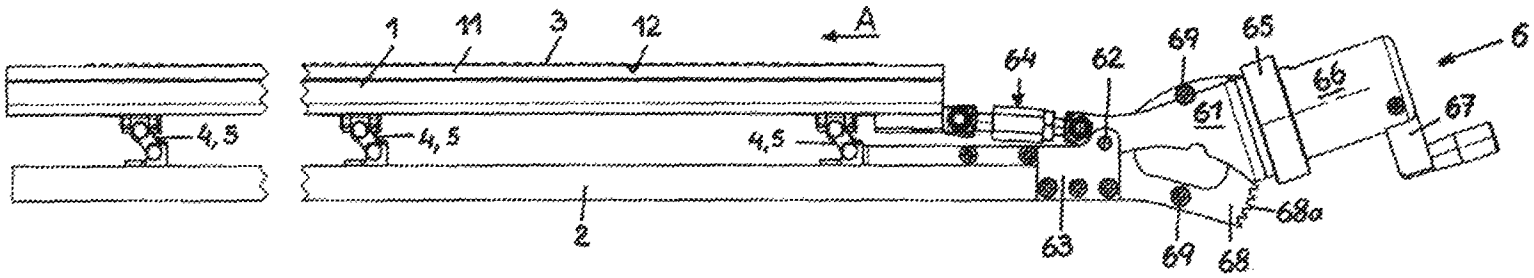
FIG. 1A depicts the support bar, the scraper bar and the positioning device according to FIG. 1, in a second position of the scraper bar with respect to the support bar, in a side view.
Figure 2:
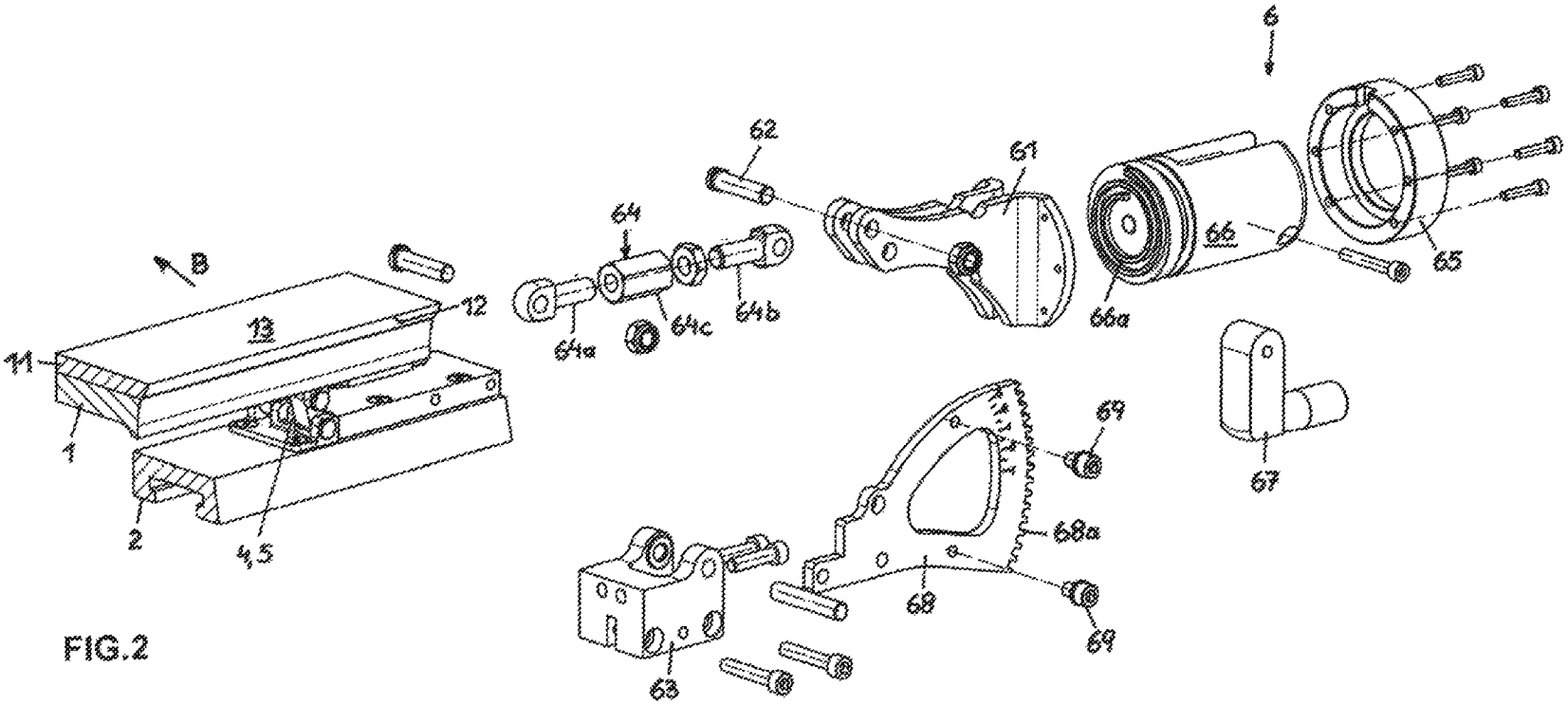
FIG. 2 depicts the support bar, the scraper bar and the positioning device according to FIG. 1 and FIG. 1A, in a disassembled axonometric representation.

Represented in FIG. 2 are the individual components of the apparatus according to FIG. 1 and FIG. 1A in an axonometric, disassembled position. As can be seen therefrom, furthermore, the positioning rod 64 consists of two bolts 64*a* and 64*b*, which are screwed into a threaded sleeve 64*c*, wherein the thread of the bolts 64*a* and 64*b* and the threaded sleeve 64*c* are configured in such a way that the positioning rod 64 is lengthened or shortened by a rotation of the threaded sleeve 64*c*. A default position of the scraper bar 1 with respect to the support bar 2 is achieved thereby. As represented in FIG. 2, furthermore, the positioning cylinder 66 is configured on its side facing towards the angled lever 61 with a spirally running groove 66*a*, into which teeth 68*a* of the positioning plate 68 protrude. The positioning plate 68, which is present between two plates of the angled lever 61 that are situated at a distance from one another, is attached to the support plates 63 and thus to the support bar 2. A rotation of the positioning cylinder 66, as a result of a number of teeth 68*a* protruding into the spiral-shaped groove 66*a* of the positioning cylinder 66, causes pivoting of the positioning cylinder 65 and thus pivoting of the angled lever 61, with the result that the scraper bar 1 is displaced with respect to the support bar 2.

The movement of the wire 3 across the surface 13 of the scraper bar 1 takes place in the direction of the arrow B.

Figure 3:
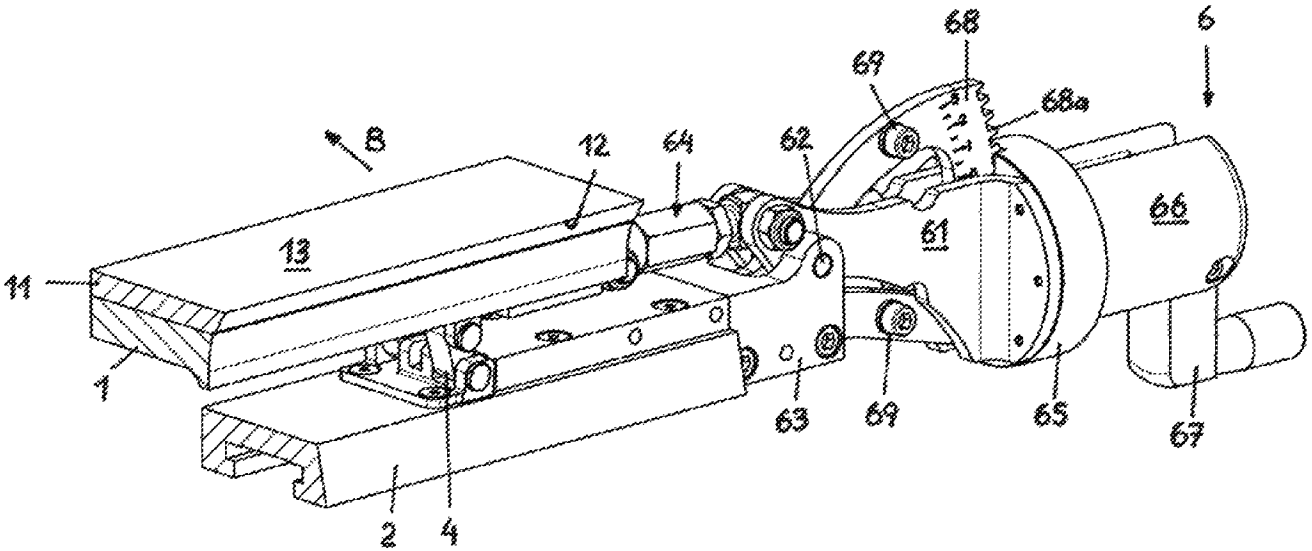
FIG. 3 depicts the support bar and the scraper bar with a link of a first embodiment coupling these two bars, in an axonometric representation.

Represented axonometrically in FIG. 3 are the scraper bar 1, the support bar 2, a link 4 coupling these two bars 1 and 2, and the positioning device 6.

Figure 3A:
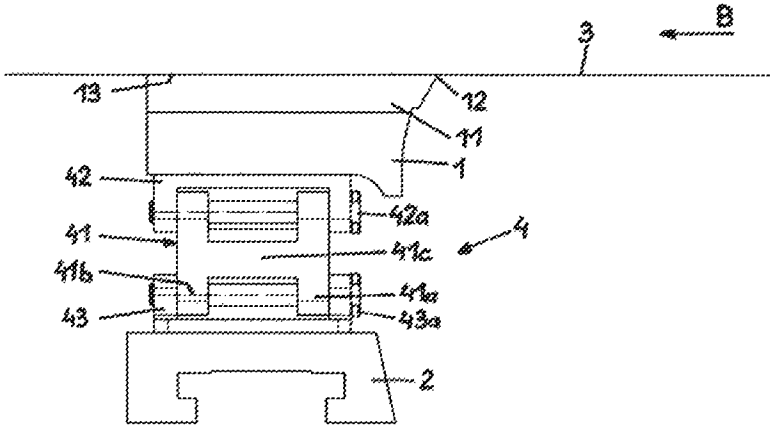
FIG. 3A depicts the support bar, the scraper bar and the link of the first embodiment coupling the scraper bar and the support bar, in a first distance position of the scraper bar with respect to the support bar, in a face view.
Figure 3B:
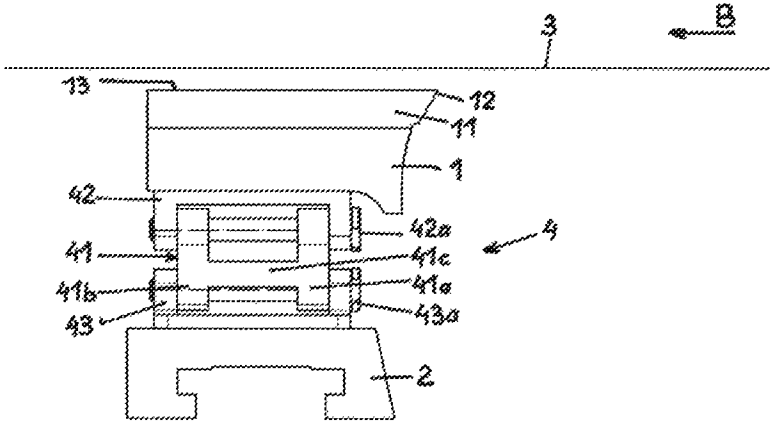
FIG. 3B depicts the support bar, the scraper bar and the link of the first embodiment in a second distance position of the scraper bar with respect to the support bar, in a face view.

As represented in FIG. 3A and FIG. 3B, a link 4 of the first embodiment, by means of which the distance between the scraper bar 1 and the support bar 2 is adjustable, is configured with an H-shaped linking element 41, which exhibits two longitudinal braces 41*a*, 41*b* and a transverse brace 41*c* connecting these together. A support plate 42 is attached to the scraper bar 1, and a support plate 43 is attached to the support bar 2. The two support plates 42, 43 are configured with transversely projecting tabs, present in which are bores, in which the linking element 41 are mounted by means of pivot bolts 42*a*, 43*a*. A displacement of the scraper bar 1 with respect to the support bar 2 causes pivoting of all the links 4 that are present between the scraper bar 1 and the support bar 2, with the result that the distance of the scraper bar 1 from the support bar 2 is changed.

In FIG. 3A, the wire 3 bears against the surface 13 of the scraper bar 1.

In FIG. 3B, the distance of the scraper bar 1 from the support bar 2 has been reduced, with the result that the scraper bar 1 has been displaced downwards away from the wire 3.

The length of the support bars and the scraper bars can be as much as 11 m. the width of the support bars and the scraper bars can be from 35 mm to 80 mm. the length of the links can be about 15 mm.

Figure 4:
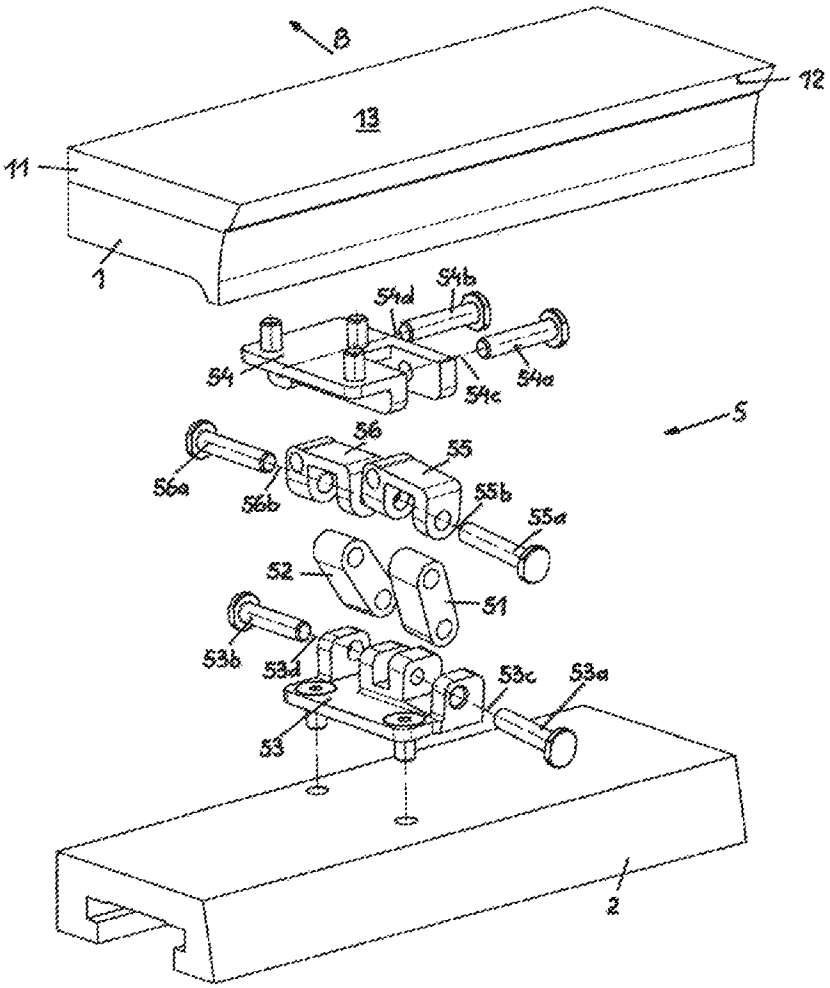
FIG. 4 depicts the support bar and the scraper bar and a link of a second embodiment coupling these two bars, in a disassembled axonometric representation.
Figure 4A:
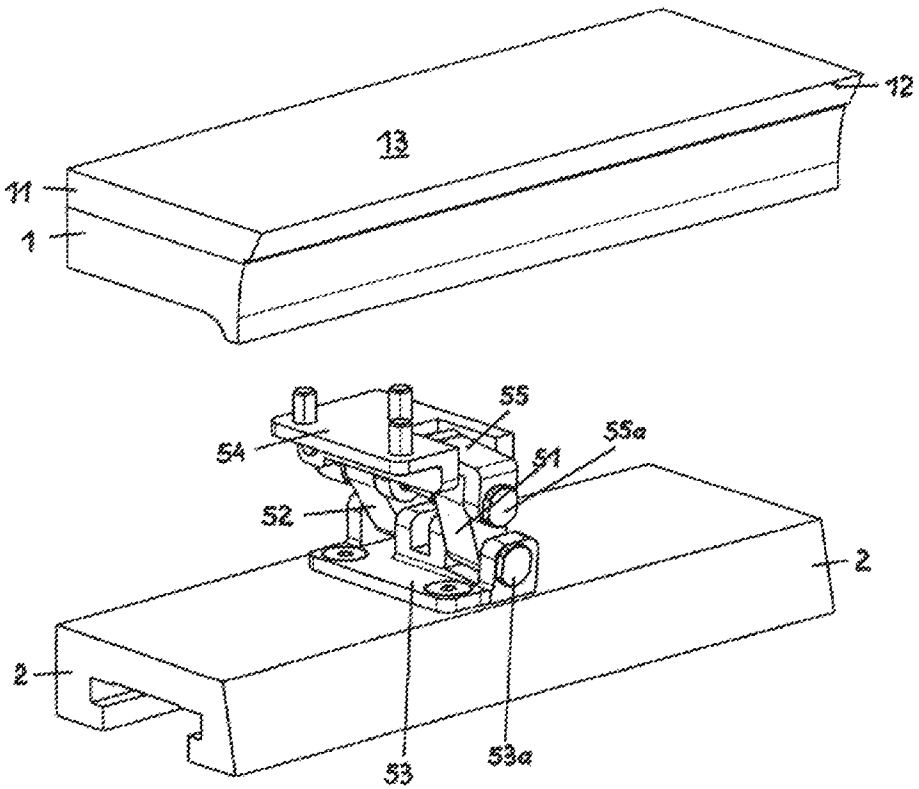
FIG. 4A depicts the support bar, the scraper bar and the link of the second embodiment coupling these two bars, in an axonometric representation.

Represented in FIG. 4 and FIG. 4A is a link 5 of the second embodiment, which serves the purpose, by a displacement of the scraper bar 1 with respect to the support bar 2, of changing the angular position of the scraper bar 1 with respect to the support bar 2 and/or with respect to the wire 3. It is possible thereby to ensure that the front scraper edge 12 of the scraper bar 1 bears against the underside of the wire 3 in the direction of movement B of the wire 3, and that the upper surface 13 of the scraper bar 1 includes an acute angle with the wire 3. A negative pressure is produced in this way on the underside of the wire 3 by the movement of the wire 3 across the scraper bar 1, by means of which negative pressure a suction force is exerted on the wire 3 and/or on the liquid which exits from the mixture of substances that is present on the wire 3.

The link 5 exhibits two linking elements 51 and 52, which are mounted by means of pivot bolts 53*a*, 53*b* on a support plate 53, which is attached to the support bar 2. The support plate 53 is provided for this purpose with transversely projecting tabs, which are provided with bores, into which the pivot bolts 53*a*, 53*b* are inserted. In this case, the pivot axes 53*c*, 53*d* of the two linking elements 51, 52 together enclose an acute angle of 5.5°, for example. A support plate 54 is attached to the scraper bar 1, in which support plate U-shaped support elements 55, 56 are pivotably mounted by means of pivot bolts 54*a*, 54*b*, wherein their pivot axes 54*c*, 54*d* are oriented parallel to one another. The other ends of the linking elements 51, 52 are mounted by means of pivot bolts 55*a*, 56*a* in the U-shaped support elements 55, 56, wherein the pivot axes 55*b*, 56*b* likewise include an acute angle of 5.5°, for example, with one another. The pivot axes 53*c*, 55*b* and/or 53*d*, 56*b* are oriented parallel to one another. The pivot axes 54*c* and 55*b*, as well as the pivot axes 54*d* and 56*b* run at an angle of about 90° in relation to one another and intersect one another spatially.

The linking element 51 is thus capable of pivoting about the pivot axes 53*c* and 55*b*, and the support element 55 assigned thereto is capable of pivoting about the pivot axis 54*c* with respect to the support plate 54. The linking element 52 is similarly capable of pivoting about the pivot axes 53*d* and 56*b*, and the support element 56 assigned thereto is capable of pivoting about the pivot axis 54*d* with respect to the support plate 54. The linking elements 51 and 52 are capable of pivoting in different ways by means of these multiple bearings. In the initial position, the linking elements 51 and 52 enclose acute angles with the vertical plane, wherein the linking element 51 is inclined rather less than the linking element 52. A displacement of the scraper bar 1 with respect to the support bar 2 changes its angular position with respect to the support bar 2 and/or with respect to the wire 3.

A displacement of the scraper bar 1 in the direction of the arrow A (see FIG. 1, FIG. 1A) causes the linking elements 51 and 52 to pivot further with respect to the vertical plane, with the result that the scraper bar 1 is displaced downwards by means of the linking elements 51 and 52 and the support elements 53 and 56. Since the pivot axes of the two linking elements 51 and 52 enclose an acute angle with one another, the displacement of the support element 56 in the downward direction by the linking element 52 is greater than the displacement of the support element 55 by the linking element 51, with the result that the support plate 54 and with it the scraper bar 1 are displaced about the pivot bolts 54*a*, 54*b* in the clockwise direction. The scraper bar 1 is displaced thereby with respect to the support bar 2. In this case, the pivoting of the scraper bar 1 can be controlled in such a way that its scraper edge 12 remains on the underside of the wire 3.

Figure 4B:
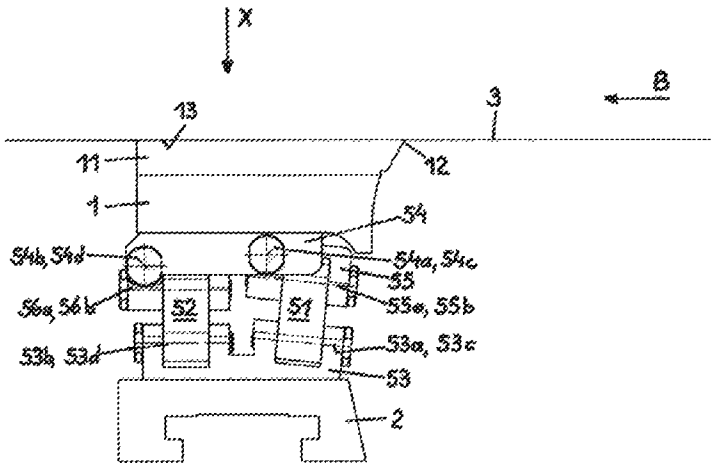
FIG. 4B depicts the support bar, the scraper bar and the link of the second embodiment coupling the support bar and the scraper bar in a first angular position of the scraper bar with respect to the support bar, in a face view.
Figure 4C:
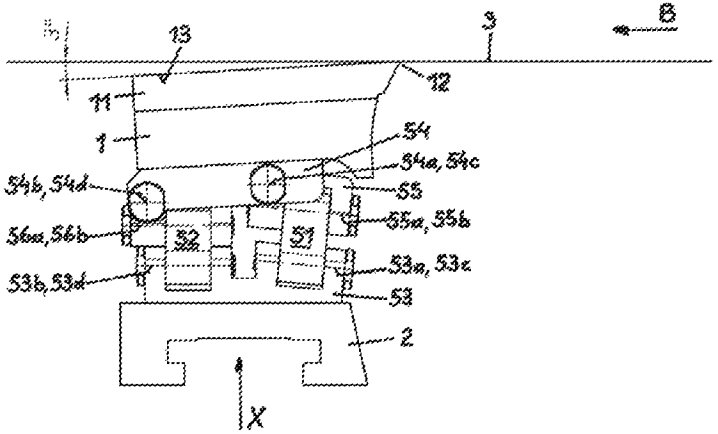
FIG. 4C depicts the support bar, the scraper bar and the link of the second embodiment coupling the support bar and the scraper bar in a second angular position of the scraper bar with respect to the support bar, in a face view.

Represented in FIG. 4B is the position of the scraper bar 1, in which its surface 13 bears against the underside of the wire 3 over its entire surface. As soon as the scraper bar 1 has been displaced in its angular position because of the adjusting movement with respect to the support bar 2 and/or the wire 3 caused by the linking elements 51, 52, the support elements 55 and 56 and the support plate 54, wherein the scraper edge 12 of the scraper bar 1 remains on the underside of the wire 3, its surface 13 encloses an acute angle of 3°, for example, with the wire 3. This position of the scraper bar 1 is represented in FIG. 4C.

Figure 5A:
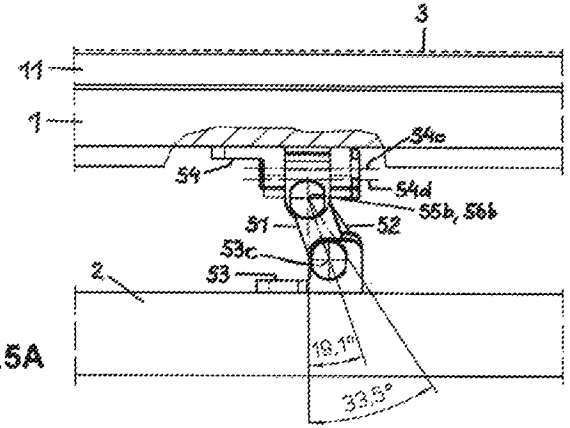
FIG. 5, FIG. 5A depict the support bar, the scraper bar and the link of the second embodiment coupling the support bar and the scraper bar, in the first angular position of the support bar and the scraper bar relative to one another, in a face view and in a side view.
Figure 5C:
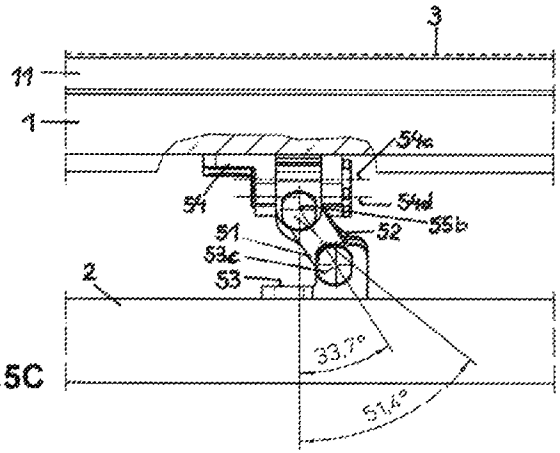
FIG. 5B, FIG. 5C depict the support bar, the scraper bar and the link of the second embodiment coupling the support bar and the scraper bar, in the second angular position of the scraper bar and the support bar relative to one another, in a face view and in a side view.
Figure 5:
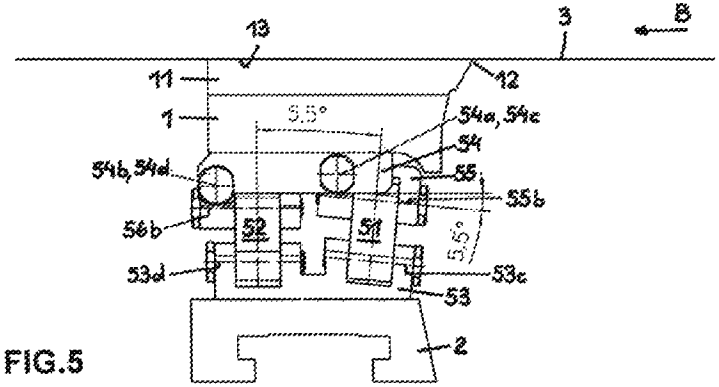
Figure 6A:
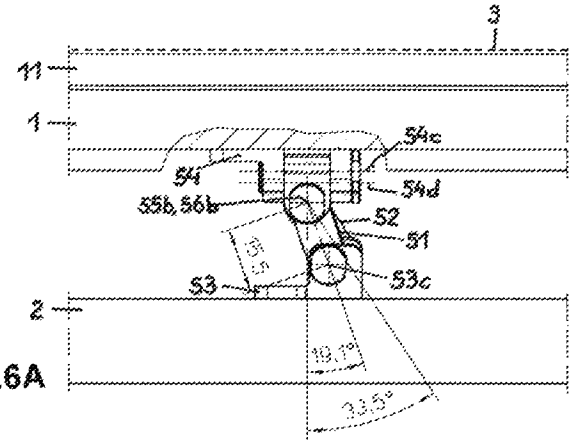
FIG. 6, FIG. 6A, FIG. 6B, FIG. 6C depict the support bar, the scraper bar and the link of the second embodiment coupling the support bar and the scraper bar according to FIG. 5 to FIG. 5C with measurements.
Figure 6C:
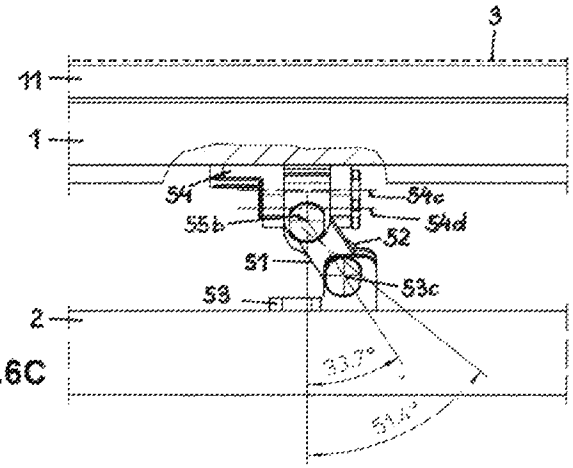
Figure 6:
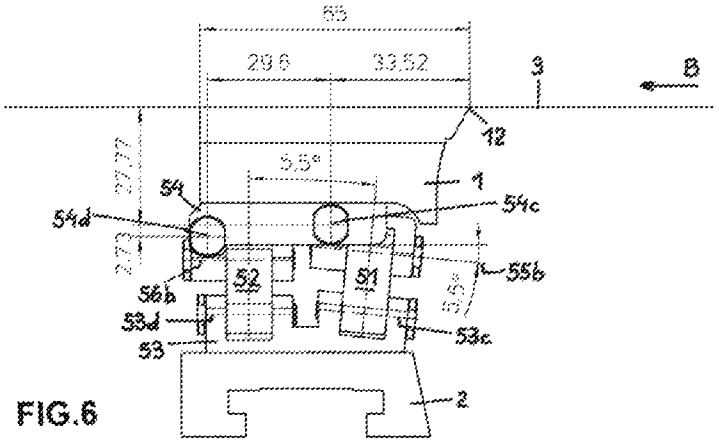
Figure 6B:
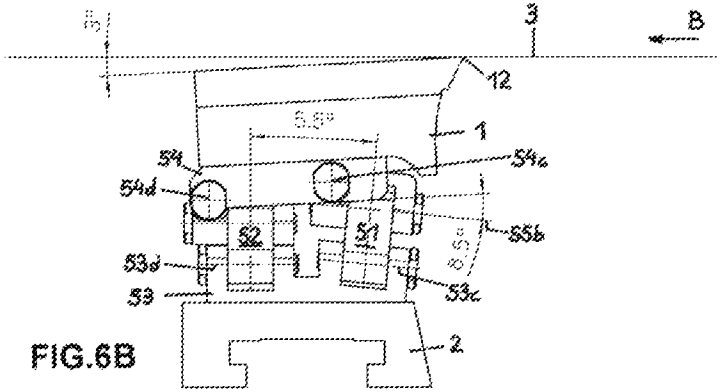

An illustrative example is represented in FIG. 5 to FIG. 5C and in FIG. 6 to FIG. 6C.

In the initial position represented in FIG. 5 and FIG. 5A, the normal planes on the pivot axes 53*c*, 55*b* of the linking element 51 and on the pivot axes 53*d*, 56*b* of the linking element 52 enclose an angle of 5.5° with one another, and the pivot axis 55*b* of the pivot bolt 55*a* encloses an angle of 5.5° with the support plate 54. In addition, the central plane of the linking element 51 encloses an angle of 19.1° with the vertical plane, and the central plane of the linking element 52 encloses an angle of 33.5° with the vertical plane.

Figure 5B:
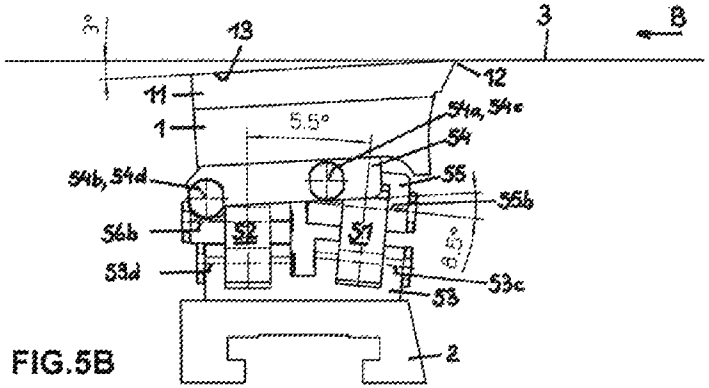

The pivoting of the scraper bar 1 is explained on the basis of FIG. 5B and FIG. 5C. If the scraper bar 1 is displaced by 3.5 mm with respect to the support bar 2, the angular positions of the linking elements 51 and 52 are increased to the extent that the central plane of the linking element 51 encloses an angle of 33.7° with the vertical plane, and the central plane of the linking element 52 encloses an angle of 51.4° with the vertical plane. Because of this positioning movement, the scraper bar 1 is caused to pivot in such a way that its surface 13 encloses an angle of 3° with the wire 3. The angle which the pivot axis 55*b* encloses with the support plate 54 is increased to 8.5° as a result.

The normal planes on the pivot axes of the linking element 51 and of the linking element 52 remain at an angle of 5.5°.

As can be appreciated from FIG. 6, FIG. 6A, FIG. 6B and FIG. 6C, according to this illustrative embodiment, the scraper bar 1 exhibits a width of 65 mm, and the linking elements 51 and 52 each exhibit a length of 15.5 mm. The mean distance of the two linking elements from one another is 28.25 mm. Furthermore, the pivot axis 54*c* is situated at a distance of 33.52 mm and at a vertical distance of 27.77 mm from the scraper edge 12, and the pivot axis 54*d* is situated at a longitudinal distance of 63.12 mm and at a vertical distance of 30.5 mm from the scraper edge 12.

Then advantage of this constructive design is that the scraper bar is used for the sliding movement for the displacement of the scraper bar with respect to the support bar, for which reason no guide blocks are required, and that very large sliding forces can be transmitted by the scraper bar, which is very heavily dimensioned per se, with the result that any contamination of the links connecting the scraper bar and the support bar and increased friction in the pivot bearings resulting therefrom are not significant.

It is primarily important for the invention that, in a line for producing paper, as a result of the connection of a scraper bar to a support bar by means of pivotable linking elements and pivotable support elements, the elevation or the angular position of the scraper bar with respect to the support bar and thus with respect to the wire can be changed by a displacement of the scraper bar with respect to the support bar.

The invention claimed is:

1. An apparatus for adjusting a scraper bar in a line for producing a paper web with a wire and scraper bars oriented transversely to a direction of movement of the wire and situated at a spacing distance from one another, the apparatus comprising:

a support bar supporting the scraper bar adjustably with respect to said support bar and with respect to the wire;

a positioning device for adjusting said scraper bar with respect to said support bar and with respect to the wire;

links mounted to the scraper bar and to said support bar for coupling the scraper bar and said support bar to one another;

wherein a distance or an angular position of the scraper bar with respect to said support bar and with respect to the wire is adjusted by a displacement of the scraper bar with respect to said support bar; and support plates attached to the scraper bar and to said support bar and linking elements mounted on said support plates, said linking elements having pivot bolts oriented transversely to a longitudinal direction of the scraper bar and/or the direction of sliding.

2. The apparatus according to claim 1, wherein said positioning device comprises a pivotable angled lever mounted on said support bar and a positioning rod having a first end linked to said angled lever and a second end linked to the scraper bar, wherein the scraper bar is capable of displacement parallel to said support bar by pivoting said angled lever.

3. The apparatus according to claim 2, wherein said positioning rod is adjustable in an effective length thereof.

4. The apparatus according to claim 2, which comprises a positioning cylinder mounted on said angled lever and pivotable with said angled lever, and wherein said positioning cylinder is rotatably mounted with respect to said angled lever.

5. The apparatus according to claim 4, which comprises a crank for causing said positioning cylinder to rotate.

6. The apparatus according to claim 2, which comprises:

a rotatable positioning cylinder assigned to said angled lever, said positioning cylinder being formed with a spirally running groove on a side thereof facing towards said angled lever; and a positioning plate in the form of a curved arch and configured with teeth attached to said support bar;

wherein said positioning plate is disposed to interact with said spirally running groove in such a way that the angled lever is capable of being caused to pivot by rotation of said positioning cylinder.

7. The apparatus according to claim 2, wherein said angled lever is disposed to pivot between two abutments.

8. The apparatus according to claim 1, wherein said linking elements are H-shaped, having two longitudinal braces disposed at a distance from one another and having a transverse brace connecting said longitudinal braces together, and wherein free ends of said longitudinal braces are penetrated by said pivot bolts.

9. An apparatus for adjusting a scraper bar in a line for producing a paper web with a wire and scraper bars oriented transversely to a direction of movement of the wire and situated at a spacing distance from one another, the apparatus comprising:

a support bar supporting the scraper bar adjustably with respect to said support bar and with respect to the wire;

a positioning device for adjusting said scraper bar with respect to said support bar and with respect to the wire;

links mounted to the scraper bar and to said support bar for coupling the scraper bar and said support bar to one another; and wherein a distance or an angular position of the scraper bar with respect to said support bar and with respect to the wire is adjusted by a displacement of the scraper bar with respect to said support bar; and a support plate attached to said support bar and having mounted thereon first ends of two linking elements, wherein pivot axes of said linking elements together enclose an acute angle of 1° to 10°, wherein second ends of said linking elements are mounted on support elements, which are mounted on a support plate attached to the scraper bar, wherein pivot axes of said linking elements mounted on said support elements and the pivot axes of said support elements, which are mounted on said support plate attached to the scraper bar, intersect one another spatially.

10. The apparatus according to claim 9, wherein said pivot axes of said linking elements mounted on said support elements together enclose an acute angle of about 5°.

11. The apparatus according to claim 9, wherein an angular position of the scraper bar with respect to said support bar is adjustable by as much as 5° by a displacement of the scraper bar with respect to said support bar.

12. The apparatus according to claim 11, wherein the angular position of the scraper bar with respect to said support bar is adjustable by as much as 3° by the displacement of the scraper bar with respect to said support bar.

13. The apparatus according to claim 9, wherein said two linking elements in an initial position thereof exhibit different angular positions in relation to a vertical plane, which, in the event of a displacement of the scraper bar with respect to said support bar, increase to greater angles.

14. The apparatus according to claim 13, wherein the initial position of said two linking elements are at angular positions of 19.1° and 33.5° in relation to the vertical plane, which, in the event of a displacement of the scraper bar with respect to said support bar, increase to angular positions of 33.7° and 51.5° in relation to the vertical plane.

15. An apparatus for adjusting a scraper bar in a line for producing a paper web with a wire and scraper bars oriented transversely to a direction of movement of the wire and situated at a spacing distance from one another, the apparatus comprising:

a support bar supporting the scraper bar adjustably with respect to said support bar and with respect to the wire;

a positioning device for adjusting said scraper bar with respect to said support bar and with respect to the wire;

links mounted to the scraper bar and to said support bar for coupling the scraper bar and said support bar to one another;

wherein a distance or an angular position of the scraper bar with respect to said support bar and with respect to the wire is adjusted by a displacement of the scraper bar with respect to said support bar; and wherein said positioning device comprises a pivotable angled lever mounted on said support bar and a positioning rod having a first end linked to said angled lever and a second end linked to the scraper bar, wherein the scraper bar is capable of displacement parallel to said support bar by pivoting said angled lever.

16. The apparatus according to claim 15, wherein said positioning rod is adjustable in an effective length thereof.

17. The apparatus according to claim 15, which comprises a positioning cylinder mounted on said angled lever and pivotable with said angled lever, and wherein said positioning cylinder is rotatably mounted with respect to said angled lever.

18. The apparatus according to claim 15, which comprises:

a rotatable positioning cylinder assigned to said angled lever, said positioning cylinder being formed with a spirally running groove on a side thereof facing towards said angled lever; and a positioning plate in the form of a curved arch and configured with teeth attached to said support bar;

wherein said positioning plate is disposed to interact with said spirally running groove in such a way that the angled lever is capable of being caused to pivot by rotation of said positioning cylinder.

19. The apparatus according to claim 15, wherein said angled lever is disposed to pivot between two abutments.

20. The apparatus according to claim 15, which comprises a crank for causing said positioning cylinder to rotate.

* * * * *